US011118439B2

(12) United States Patent
Fathi et al.

(10) Patent No.: US 11,118,439 B2
(45) Date of Patent: Sep. 14, 2021

(54) DISPLACING FLUID FOR ENHANCED OIL RECOVERY

(71) Applicant: Saudi Arabian Oil Company, Dhahran (SA)

(72) Inventors: Mazin M. Fathi, Dhahran (SA); Ki-Hyouk Choi, Dhahran (SA); Muneef F. AlQarzouh, Dhahran (SA)

(73) Assignee: SAUDI ARABIAN OIL COMPANY

( * ) Notice: Subject to any disclaimer, the term of this patent is extended or adjusted under 35 U.S.C. 154(b) by 17 days.

(21) Appl. No.: 16/706,400

(22) Filed: Dec. 6, 2019

(65) Prior Publication Data

US 2021/0172311 A1 Jun. 10, 2021

(51) Int. Cl.
*E21B 43/40* (2006.01)
*E21B 43/20* (2006.01)

(52) U.S. Cl.
CPC ..... *E21B 43/40* (2013.01); *E21B 43/20* (2013.01)

(58) Field of Classification Search
None
See application file for complete search history.

(56) References Cited

U.S. PATENT DOCUMENTS 3,733,259 A * 5/1973 Wilson et al. ..... C10G 31/08 208/86
4,151,068 A 4/1979 McCollum
7,730,958 B2 6/2010 Smith
9,593,563 B2 3/2017 Johnsen et al.
2007/0267325 A1 11/2007 Vu
2009/0159504 A1 6/2009 Choi
2009/0166262 A1 7/2009 He et al.
2010/0243248 A1 9/2010 Golomb et al.
2010/0314583 A1 12/2010 Banerjee
2013/0140214 A1 6/2013 Choi
2014/0110109 A1 4/2014 Latimer et al.
2014/0224491 A1 8/2014 Segerstrom
2017/0107433 A1 4/2017 Choi
2017/0342332 A1 11/2017 Choi et al.
2018/0163143 A1 6/2018 Choi et al.
2019/0062638 A1 2/2019 Choi et al.

OTHER PUBLICATIONS

PCT Search Report dated Feb. 26, 2021, in the prosecution of patent application No. PCT/US2020/062829, 13 pages.

* cited by examiner

*Primary Examiner* — Andrew Sue-Ako
(74) *Attorney, Agent, or Firm* — Bracewell LLP; Constance Gall Rhebergen

(57) ABSTRACT

A process directed toward enhanced oil recovery in an oil-containing formation, the process comprising the steps of removing a water/oil emulsion from an oil-water separator, wherein the water/oil emulsion comprises a stable emulsion, wherein a temperature of the water/oil emulsion is less than 120 deg C., wherein a pressure of the water/oil emulsion is greater than the saturation pressure at the temperature of the water/oil emulsion, wherein the water/oil emulsion comprises an alkali content, and introducing the water/oil emulsion into the oil-containing formation as an enhanced oil recovery stream, wherein the enhanced oil recovery stream is used in enhanced oil recovery.

19 Claims, 5 Drawing Sheets

DISPLACING FLUID FOR ENHANCED OIL RECOVERY

TECHNICAL FIELD

Disclosed are methods for upgrading petroleum. Specifically, disclosed are methods and systems for upgrading petroleum using pretreatment processes.

BACKGROUND

Capillary forces in the pore spaces of a hydrocarbon formation can play a significant role in trapping oil. These capillary forces can reduce oil displacement and therefore entrap huge amounts of oil in the hydrocarbon formation. In order to improve oil production from depleted oil wells these capillary forces must be overcome by higher opposing force such as viscous forces. Viscous forces, produced by the flow of the displacing fluid, can counteract the capillary forces resulting in the release of the trapped oil. As the viscosity difference between the low viscosity displacing fluid and high viscosity oil increases, channeling in the reservoir takes place where the displacing fluid follows the already oil depleted channels and voids and bypasses un-swept sections of the hydrocarbon formation, which results in inefficient oil sweep and an early displacing fluid breakthrough.

Supercritical water and steam have both been explored as a displacement fluid. Supercritical water and steam can be used to reduce the viscosity of the oil to improve its fluidity and mobility and as a carrier media to transport the oil out of the oil well. However, once the major oil pocket inside the well becomes depleted, the capillary forces in the formation rocks that limit oil migration become highly pronounced, reducing the effectiveness of the supercritical water or steam in producing oil. Additionally, supercritical water is prone to losing its effectiveness if the conditions of the formation are less than the critical conditions of water.

Using an emulsion as a displacing fluid can reduce the capillary forces and improve the oil mobility due to the viscosity of the emulsion as the displacing fluid, thus allowing oil to break free from the well formation. As the viscosity of emulsion increases, the sweep efficiency improves, which is of increased importance in heavy oil reservoirs due to high oil viscosity.

Conventional emulsions useful as displacing fluids require additives to maintain a stable emulsion. Such additives can include polymers, surfactants, alkaline agents and combinations of the same. The droplets in the dispersed phase of the displacing fluid can block the more permeable paths in the hydrocarbon formation which forces the displacing fluid to flow through unswept sections of the formations.

SUMMARY

Disclosed are methods for upgrading petroleum. Specifically, disclosed are methods and systems for upgrading petroleum using pretreatment processes.

In a first aspect, a process directed toward enhanced oil recovery in an oil-containing formation is provided. The process includes the steps of removing a water/oil emulsion from an oil-water separator, where the water/oil emulsion includes a stable emulsion, where a temperature of the water/oil emulsion is less than 120 deg C., where a pressure of the water/oil emulsion is greater than the saturation pressure at the temperature of the water/oil emulsion, where the water/oil emulsion includes an alkali content, and introducing the water/oil emulsion into the oil-containing formation as an enhanced oil recovery stream, where the enhanced oil recovery stream is used in enhanced oil recovery.

In certain aspects, the process further includes the steps of introducing the water/oil emulsion to a desalter mixer, introducing a desalter water to the desalter mixer, where the desalter water includes an alkali content, where the alkali content is the range between 26,000 parts-per-million by weight (ppmw) and 367,500 ppmw, mixing the water/oil emulsion and the desalter water in the desalter mixer to produce a stabilized emulsion, and introducing the stabilized emulsion into the oil-containing formation as an enhanced oil recovery stream, where the enhanced oil recovery stream is used in enhanced oil recovery. In certain aspects, the process further includes the steps of introducing the stabilized emulsion to a production mixer, introducing a produced water stream to the production mixer, where an alkali content of the produced water stream is in the range between 20,000 ppmw and 600,000 ppmw, mixing the stabilized emulsion and the produced water stream in the production mixer to produce a mixed recovery water, and introducing the mixed recovery water into the oil-containing formation as an enhanced oil recovery stream, where the enhanced oil recovery stream is used in enhanced oil recovery. In certain aspects, the process further includes the steps of separating a separated water stream from the water/oil emulsion, introducing the separated water stream to a waste water treatment facility, treating the separated water stream in the waste water treatment facility to produce a treated water stream, where the treated water stream includes fewer contaminants than the separated water stream, and mixing the treated water stream with a pressurized water feed to a produce mixed water feed. In certain aspects, the process further includes the steps of increasing a pressure of an oil feed in an oil pump to produce a pressurized oil feed, where an alkali content of the oil feed is less than 300 pounds per thousand barrels, increasing a temperature of the pressurized oil feed in an oil heater to produce a pre-heated oil feed, where the temperature of the pre-heated oil is in the range between 50 deg C. and 250 deg C., introducing the pre-heated oil feed to a mixer, increasing a pressure of a water feed in a water pump to produce a pressurized water feed, increasing a temperature of the pressurized water feed in a water cross-heater to produce a pre-heated water feed, increasing a temperature of the pre-heated water feed in a water heater to produce a supercritical water feed, where a temperature of the supercritical water feed is in the range between 374 deg C. and 600 deg C., introducing the supercritical water feed to the mixer, mixing the pre-heated oil feed and the supercritical water feed to produce a mixed feed, where a volumetric ratio of the volumetric flow rate of the supercritical water feed to the volumetric flow rate of the pre-heated oil feed is in the range between 5:1 to 1:1, introducing the mixed feed to a supercritical water (SCW) reactor, treating the mixed feed in the SCW reactor to produce a reactor effluent, where a reaction temperature in the SCW reactor is in the range between 380 deg C. and 600 deg C., where a reaction pressure is in the range between 22 MPa and 30 MPa, where a residence time in the SCW reactor is in the range between 10 seconds and 60 minutes, reducing a temperature of the reactor effluent in the water cross-heater to produce a pre-cooled effluent, reducing a temperature of the pre-cooled effluent in a process cooler to produce a cooled effluent, where a temperature of the cooled effluent is less than 120 deg C., reducing a pressure of the cooled effluent in a pressure reducing element to produce a depressurized effluent, where the depressurized effluent is at a pressure greater than the saturation pressure of water at the temperature of the cooled effluent, and separating the depressurized effluent in the oil-water separator to produce a gas product stream, an upgraded oil product, and the water oil emulsion, where the upgraded oil product contains upgraded hydrocarbons relative to the hydrocarbons in the oil feed. In certain aspects, the alkali content of the water/oil emulsion is in the range between 100 ppmw and 30,000 ppmw. In certain aspects, the oil feed includes oil recovered in the enhanced oil recovery. In certain aspects, the amount of oil in the water/oil emulsion is in the range between 30,000 ppmw and 400,000 ppmw. In certain aspects, the operating conditions in the oil-separator are maintained such that greater than 95 wt % of the water in the oil-water separator is in the liquid phase.

In a second aspect, a system for producing an enhanced oil recovery stream for enhanced oil recovery is provided. The system includes a supercritical water (SCW) reactor, the SCW reactor is configured to treat a mixed feed to produce a reactor effluent, where the mixed feed includes a pre-heated oil feed and a supercritical water feed, where a reaction temperature in the SCW reactor is in the range between 380 deg C. and 600 deg C., where a reaction pressure is in the range between 22 MPa and 30 MPa, where a residence time in the SCW reactor is in the range between 10 seconds and 60 minutes, a water cross-heater fluidly connected to the SCW reactor, the SCW reactor is configured to reduce a temperature of the reactor effluent to produce a pre-cooled effluent, a process cooler fluidly connected to the water cross-heater, the process cooler is configured to reduce a temperature of the pre-cooled effluent in to produce a cooled effluent, where a temperature of the cooled effluent is less than 120 deg C., a pressure reducing element fluidly connected to the process cooler, the pressure reducing element is configured to reduce a pressure of the cooled effluent to produce a depressurized effluent, where the depressurized effluent is at a pressure greater than the saturation pressure of water at the temperature of the cooled effluent, an oil-water separator fluidly connected to the pressure reducing element, the oil-water separator is configured to separate the depressurized effluent to produce a gas product stream, an upgraded oil product, and a water oil emulsion, where the upgraded oil product contains upgraded hydrocarbons relative to the hydrocarbons in the oil feed, where the water/oil emulsion includes a stable emulsion, where a pressure of the water/oil emulsion is greater than the saturation pressure at the temperature of the water/oil emulsion, where the water/oil emulsion includes an alkali content.

In certain aspects, the system further includes an oil-containing formation fluidly connected to the oil-water separator, where the water/oil emulsion is operable to be injected into the oil-containing formation as the enhanced oil recovery stream. In certain aspects, the system further includes a desalter mixer fluidly connected to the oil-water separator, the desalter mixer is configured to mix the oil/water emulsion and a desalter water to produce a stabilized emulsion, where the desalter water contains an alkali content, where the alkali content is in the range between 26,000 ppmw and 367,500 ppmw. In certain aspects, the system further includes a production mixer fluidly connected to the desalter mixer, the production mixer is configured to mix the stabilized emulsion and a produced water stream to produce a mixed recovery water. In certain aspects, the system further includes a waste water treatment facility, the waste water treatment facility is configured to treat a separated water stream to produce a treated water stream, where the separated water stream is separated from the water/oil emulsion. In certain aspects, the system further includes an oil pump, the oil pump is configured to increase a pressure of an oil feed to produce a pressurized oil feed, where an alkali content of the oil feed is less than 300 pounds per thousand barrels, an oil heater fluidly connected to the oil pump, the oil heater is configured to increase a temperature of the pressurized oil feed to produce a pre-heated oil feed, where the temperature of the pre-heated oil is in the range between 50 deg C. and 250 deg C., a water pump, the water pump is configured to increase a pressure of a water feed to produce a pressurized water feed, a water cross-heater fluidly connected to the water pump, the water cross-heater is configured to increase a temperature of the pressurized water feed to produce a pre-heated water feed, a water heater fluidly connected to the water cross-heater, the water heater is configured to increase a temperature of the pre-heated water feed to produce a supercritical water feed, where a temperature of the supercritical water feed is in the range between 374 deg C. and 600 deg C., a mixer fluidly connected to the oil heater and the water heater, the mixer is configured to mix the pre-heated oil and the supercritical water feed to produce the mixed feed. In certain aspects, a volumetric ratio of the volumetric flow rate of the supercritical water feed to the volumetric flow rate of the pre-heated oil feed is in the range between 5:1 to 1:1.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
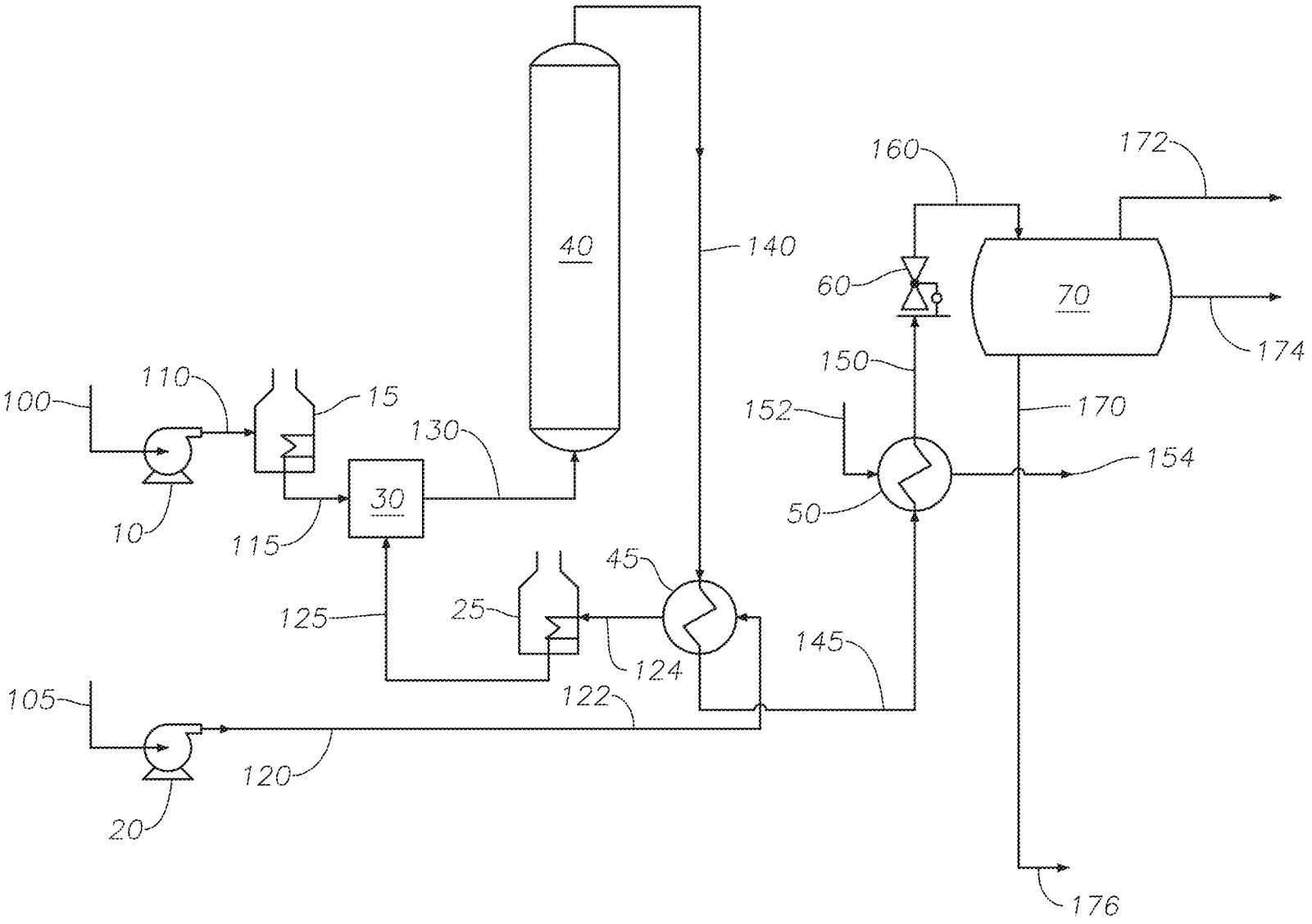
FIG. 1 provides a process diagram of an embodiment of the upgrading process.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

The processes and systems described are directed to producing a displacement fluid for use in an oil-containing formation. The process provides methods and apparatus for producing light olefins. Advantageously, the systems and processes to produce a displacement fluid for use in an oil-containing formation described here can form an integrated interface between downstream processes, such as refining processes or conversion processes of produced and treated crude oils, and upstream processes, such as those that treat crude oils produced from well formation and includes gas oil separation plants. Advantageously, using the water/oil emulsion as an injection fluid reduces the water that has to be disposed and produces an integrated process. Advantageously, the water/oil emulsion can be produced without added emulsifiers. Advantageously, the systems and processes to produce a displacement fluid for use in an oil-containing formation can be retrofitted on an existing supercritical water process. Advantageously, the use of water/oil emulsion as a displacement fluid can recover more oil in an enhanced oil recovery process compared to the use of a conventional water flooding. An emulsion of water and oil has reduced interfacial tension and increased viscosity compared to fluid in a conventional water flooding process. Advantageously, the average diameter of the droplets of oil in the emulsion of oil and water can be greater than the average diameter of the pores in the oil-containing formation.

As used throughout, "external supply of hydrogen" refers to the addition of hydrogen to the feed entering the reactor or to the reactor itself. For example, a reactor in the absence of an external supply of hydrogen means that the feed to the reactor and the reactor are in the absence of added hydrogen, gas ($H_2$) or liquid, such that no hydrogen (in the form of $H_2$) is a feed or a part of a feed to the reactor.

As used throughout, "external supply of catalyst" refers to the addition of catalyst to the feed entering the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout, "supercritical water" refers to water at a temperature at or greater than the critical temperature of water and at a pressure at or greater than the critical pressure of water. The critical temperature of water is 373.946° C. The critical pressure of water is 22.06 mega-pascals (MPa). It is known in the art that hydrocarbon reactions in supercritical water upgrade heavy oil and crude oil containing sulfur compounds to produce products that have lighter fractions. Supercritical water has unique properties making it suitable for use as a petroleum reaction medium where the reaction objectives can include conversion reactions, desulfurization reactions denitrogenation reactions, and demetallization reactions. Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water-gas shift reaction. In the water-gas shift reaction, carbon monoxide and water react to produce carbon dioxide and hydrogen. The resulting hydrogen can be transferred to hydrocarbons in conversion desulfurization reactions, demetallization reactions, denitrogenation reactions, and combinations.

As used throughout, "external surfactants" refers to the addition of additives, surfactants, emulsifiers to the emulsion of oil and water to improve or maintain the stability of the emulsion. For example, an absence of external surfactants means no additives, surfactants, or emulsifiers have been added to the emulsion of oil and water.

As used throughout, "natural surfactants" refers to compounds naturally occurring in the crude oil. Natural surfactants can include asphaltenes, waxes, resins, naphthenic acids, and combinations of the same.

As used throughout, "alkali content" refers to an amount of alkali metals and alkaline earth metals. Alkali metals refers to those in the IUPAC group number 1, including lithium, sodium, potassium, rubidium, cesium, and francium. Alkaline earth metals refers to those in IUPAC group number 2, including beryllium, magnesium, calcium, strontium, barium, and radium.

As used throughout, "indigenous species" refers to compounds present in crude oil. Indigenous species include clay particles, natural surfactants, carboxylic acid salts, and combinations of the same.

As used throughout, "coke" refers to the toluene insoluble material present in petroleum.

As used throughout, "cracking" refers to the breaking of hydrocarbons into smaller ones containing few carbon atoms due to the breaking of carbon-carbon bonds.

As used throughout, "upgrade" means one or all of increasing API gravity, decreasing the amount of heteroatoms, decreasing the amount of asphaltenes, decreasing the amount of the atmospheric fraction, increasing the amount of light fractions, decreasing the viscosity, and combinations of the same, in a process outlet stream relative to the process feed stream. One of skill in the art understands that upgrade can have a relative meaning such that a stream can be upgraded in comparison to another stream, but can still contain undesirable components such as heteroatoms.

As used throughout, "conversion reactions" refers to reactions that can upgrade a hydrocarbon stream including cracking, isomerization, alkylation, dimerization, aromatization, cyclization, desulfurization, denitrogenation, deasphalting, and demetallization.

As used throughout, "stable emulsion of oil and water" refers to a mixture of oil and water that will not separate without energy being applied. The stable emulsion of oil and water contains droplets of oil suspended in a continuous phase of water.

As used throughout, "desalter unit" refers to a piece of equipment from a refinery that can be used to remove inorganic salts, solids, and water from a crude oil. A desalter unit can include chemical or electrostatic separation methods. Desalter units can be used to treat a crude oil to meet an oil specification and to prevent corrosion, exerted by salts, solids and water, in downstream equipment.

The following embodiments, provided with reference to the figures, describe the upgrading process.

An embodiment of the process to produce a displacement fluid for use in an oil-containing formation is described with reference to FIG. 1. Oil feed 100 is introduced to oil pump 10. Oil feed 100 can be any crude oil stream with an alkali content of less than 300 pounds per thousand barrels (PTB), alternately less than 100 PTB, alternately less than 90 PTB, alternately less than 50 PTB, alternately less than 30 PTB, and alternately less than 10 PTB. Maintaining an alkali content of less than 300 PTB reduces or eliminates damage from such compounds in SCW reactor 40. Crude oil streams suitable for use as oil feed 100 include crude oils produced from production sites, desalted crude oil, atmospheric residues, vacuum residues, and hydrocracker bottoms. Crude oil can include hydrocarbons. Oil feed 100 can included the oil produced using enhanced oil recovery stream 176 after that produced is oil is treated in a gas oil separation plant.

The pressure of oil feed 100 can be increased in oil pump 10 to produce pressurized oil feed 110. Oil pump 10 can be any type of pump capable of increasing the pressure of an oil stream. The pressure of pressurized oil feed 110 can be greater than 22 MPa, alternately between 23 MPa and 30 MPa, and alternately between 23 MPa and 27 MPa. Pressurized oil feed 110 can be introduced to oil heater 15.

The temperature of pressurized oil feed 110 can be increased in oil heater 15 to produce pre-heated oil feed 115. Oil heater 15 can be any type of unit capable of increasing the temperature of a pressurized oil stream. The temperature of pre-heated oil feed 115 can be in the range between 50 degrees Celsius (deg C.) and 250 deg C., alternately in the range between 100 deg C. and 250 deg C., alternately in the range between 150 deg C. and 250 deg C., and alternately in the range between 200 deg C. and 250 deg C.

Water feed 105 is introduced to water pump 20. Water feed 105 can be any source of demineralized water. Water feed 105 can be demineralized water having a conductivity of less than 1 microSiemens per centimeter (0/cm), alternately less than 0.5 μS/cm, and alternately less than 0.1 μS/cm. Water feed 105 can be demineralized water having a sodium content of less than 5 micrograms per liter (μg/l) and alternately less than 1 μg/l. Water feed 105 can be demineralized water having a chloride content of less than 5 μg/l and alternately less than 1 μg/l. Water feed 105 can be demineralized water having a silica content of less than 3 μg/l.

The pressure of water feed 105 can be increased in water pump 20 to produce pressurized water feed 120. Water pump 20 can be any type of pump capable of increasing the pressure of a water stream. The pressure of pressurized water feed 120 can be greater than 22 MPa, alternately between 23 MPa and 30 MPa, and alternately between 23 MPa and 27 MPa. Pressurized water feed 120 can be introduced to water cross-heater 45.

The temperature of pressurized water feed 120 can be increased in water cross-heater 45 to produce pre-heated water feed 124. Water cross-heater 45 can be any type of heat exchanger capable of removing heat from one process stream and introducing the heat to a second process stream. The temperature of pre-heated water feed 124 can be in the range between 50 deg C. and 350 deg C., alternately in the range between 100 deg C. and 350 deg C., alternately in the range between 150 deg C. and 350 deg C., alternately in the range between 200 deg C. and 350 deg C., alternately in the range between 250 deg C. and 350 deg C., and alternately in the range between 300 deg C. and 350 deg C.

Figure 2:
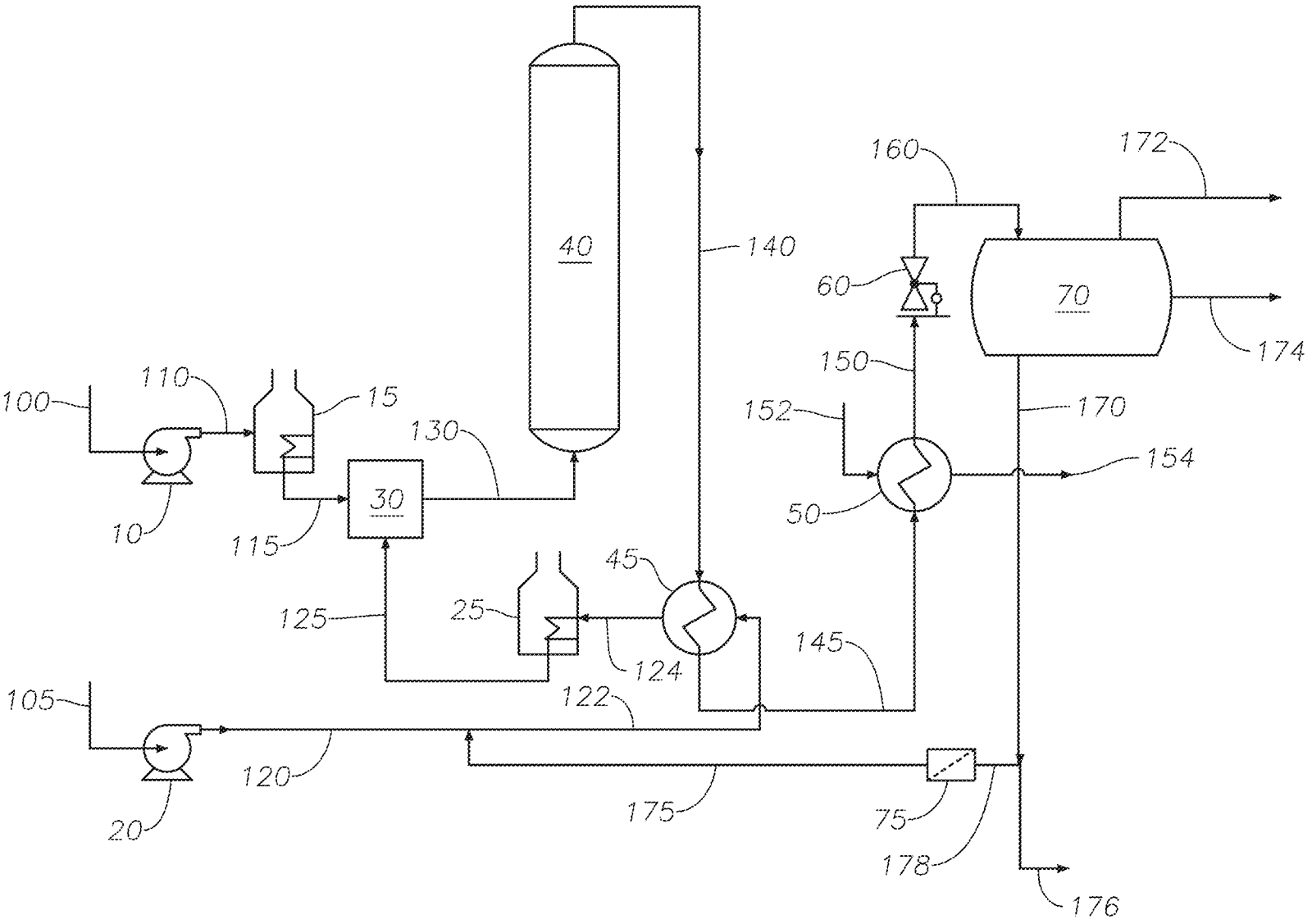
FIG. 2 provides a process diagram of an embodiment of the upgrading process

In at least one embodiment, as shown with respect to FIG. 2, treated water stream 175 can be mixed with pressurized water feed 120 to produce mixed water feed 122. Mixed water feed 122 can be introduced to water cross-heater 45 to produce pre-heated water feed 124.

Returning to FIG. 1, pre-heated water feed 124 can be introduced to water heater 25. The temperature of pre-heated water feed 124 can be increased in water heater 25 to produce supercritical water feed 125. Water heater 25 can be any type of heat exchanger capable of increasing the temperature of a pressurized water feed. The temperature of supercritical water feed 125 can be between 374 deg C. and 600 deg C. and alternately between 400 deg C. and 550 deg C. Supercritical water feed 125 contains supercritical water.

Supercritical water feed 125 can be introduced to mixer 30 along with pre-heated oil feed 115. The volumetric ratio of the volumetric flow rate of supercritical water feed 125 at standard temperature and pressure (SATP) to the volumetric flow rate of pre-heated oil feed 115 at SATP can be less than 10:1, alternately in the range between 5:1 to 1:1, and alternately in the range between 4:1 to 2:1. In no embodiment is the volumetric flow rate of supercritical water feed 125 at SATP is less than the volumetric flow rate of pre-heated oil feed 115. Maintaining a volumetric ratio of a greater amount of supercritical water feed 125 to pre-heated oil feed 115 can result in an increased volume of water/oil emulsion 170 due to increased oil dissolution capacity.

Supercritical water feed 125 and pre-heated oil feed 115 can be mixed in mixer 30 to produce mixed feed 130. Mixer 30 can be any type of mixing unit capable of mixing a supercritical water stream and hydrocarbons. Mixed feed 130 can be introduced to supercritical water (SCW) reactor 40.

Mixed feed 130 can be treated in SCW reactor 40 to produce reactor effluent 140. SCW reactor 40 can be any type of hydrocarbon upgrading unit that facilitates reaction of hydrocarbons in the presence of supercritical water. SCW reactor 40 can include vessel type of reactors and tubular type reactors. In at least one embodiment, SCW reactor 40 is a tubular type reactor. SCW reactor 40 can have dimensions such that the fluids have a Reynolds Number greater than 4,000, calculated by assuming the internal fluid in the reactor is water. SCW reactor 40 can have one or more reactors in series. SCW reactor 40 can be in the absence of an external supply of hydrogen. SCW reactor 40 can be in the absence of an external supply of catalyst. SCW reactor 40 can have reaction temperature, reaction pressure, and a reaction residence time. The reaction temperature in SCW reactor 40 can be in the range between 380 deg C. and 600 deg C., alternately between 390 deg C. and 450 deg C. Reaction temperature is measured at the outlet of SCW reactor 40. The reaction pressure in SCW reactor 40 can be in the range between 22 MPa and 30 MPa, alternately between 23 MPa and 28 MPa, and alternately between 23 MPa and 27 MPa. The residence time in SCW reactor 40 can be in the range between 10 seconds and 60 minutes, alternately between 10 minutes and 60 minutes, and alternately between 5 minutes and 30 minutes. Residence time of SCW reactor 40 can be calculated by assuming the density of the fluid in SCW reactor 40 has the density of water at reaction conditions.

It is known in the art that hydrocarbon reactions in supercritical water upgrade heavy oil and crude oil containing sulfur compounds to produce products that have lighter fractions. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.946° C. The critical pressure of water is 22.06 MPa. Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water-gas shift reaction. In the water-gas shift reaction, carbon monoxide and water react to produce carbon dioxide and hydrogen. The hydrogen can be transferred to hydrocarbons in desulfurization reactions, demetallization reactions, denitrogenation reactions, and combinations of the same. The hydrogen can also reduce the olefin content. The production of an internal supply of hydrogen can reduce coke formation.

Without being bound to a particular theory, it is understood that the basic reaction mechanism of supercritical water mediated petroleum processes is the same as a free radical reaction mechanism. Radical reactions include initiation, propagation, and termination steps. With hydrocarbons, especially heavy molecules such as $C_{10+}$, initiation is the most difficult step and conversion in supercritical water can be limited due to the high activation energy required for initiation. Initiation requires the breaking of chemical bonds. The bond energy of carbon-carbon bonds is about 350 kJ/mol, while the bond energy of carbon-hydrogen is about 420 kJ/mol. Due to the chemical bond energies, carbon-carbon bonds and carbon-hydrogen bonds do not break easily at the temperatures in a supercritical water process, 380 deg C. to 450 deg C., without catalyst or radical initiators. In contrast, aliphatic carbon-sulfur bonds have a bond energy of about 250 kJ/mol. The aliphatic carbon-sulfur bond, such as in thiols, sulfide, and disulfides, has a lower bond energy than the aromatic carbon-sulfur bond.

Thermal energy creates radicals through chemical bond breakage. Supercritical water creates a "cage effect" by surrounding the radicals. The radicals surrounded by water molecules cannot react easily with each other, and thus, intermolecular reactions that contribute to coke formation are suppressed. The cage effect suppresses coke formation by limiting inter-radical reactions. Supercritical water, having a low dielectric constant, dissolves hydrocarbons and surrounds radicals to prevent the inter-radical reaction, which is the termination reaction resulting in condensation (dimerization or polymerization). Moreover, the dielectric constant of supercritical water can be tuned by adjusting the temperature and pressure. Because of the barrier set by the supercritical water cage, hydrocarbon radical transfer is more difficult in supercritical water as compared to conventional thermal cracking processes, such as delayed coker, where radicals travel freely without such barriers.

Additionally, dissolving the hydrocarbons creates access for the water to contact the indigenous species in the crude oil. The indigenous species are attached to the oil physically and chemically. The indigenous species can interact with droplets of oil and water through hydrophilic (polar) and lipophilic (non-polar) functional groups. The indigenous species can reduce the interfacial surface tension between oil and water. The alkali content in the crude oil of mixed feed 130 can activate the natural surfactants, by converting the natural surfactants to their salts.

Sulfur compounds released from sulfur-containing molecules can be converted to $H_2S$, mercaptans, and elemental sulfur. Without being bound to a particular theory, it is believed that hydrogen sulfide is not "stopped" by the supercritical water cage due its small size and chemical structure similar to water ($H_2O$). Hydrogen sulfide can travel freely through the supercritical water cage to propagate radicals and distribute hydrogen. Hydrogen sulfide can lose its hydrogen due to hydrogen abstraction reactions with hydrocarbon radicals. The resulting hydrogen-sulfur (HS) radical is capable of abstracting hydrogen from hydrocarbons which will result in formation of more radicals. Thus, $H_2S$ in radical reactions acts as a transfer agent to transfer radicals and abstract/donate hydrogen.

Conversion reactions can occur in SCW reactor 40. The oil in SCW reactor 40 can be upgraded to produce oil having increased amounts of lighter hydrocarbon fractions relative to the hydrocarbons in oil feed 100.

Reactor effluent 140 can be introduced to water cross-heater 45. The temperature of reactor effluent 140 can be reduced in water cross-heater 45 to produce pre-cooled effluent 145. The temperature of pre-cooled effluent 145 can be less than 350 deg C. Pre-cooled effluent 145 can be introduced to process cooler 50.

The temperature of pre-cooled effluent 145 can be reduced in process cooler 50 to produce cooled effluent 150. Process cooler 50 can be any type of heat exchanger capable of reducing the temperature of reactor effluent stream. The temperature of cooled effluent 150 can be less than 120 deg C., alternately less than 90 deg C., and alternately greater than 20 deg C. Cooled effluent 150 can be introduced to pressure reducing element 60.

The pressure of cooled effluent 150 can be reduced in pressure reducing element 60 to produce depressurized effluent 160. Pressure reducing element 60 can be any type of pressure reducing unit capable of reducing the pressure of a reactor effluent stream. The pressure of depressurized effluent 160 can be greater than the saturation pressure at the temperature of cooled effluent 150. Reducing the pressure of cooled effluent 150 can induce separation of the gases from the liquids in cooled effluent 150, while maintaining the water in the liquid phase. Depressurized effluent 160 can be introduced to oil-water separator 70.

Oil-water separator 70 can be any type of vessel capable of separating a gas phase, an oil phase, and a water phase in a reactor effluent stream. Oil-water separator 70 can by a horizontal vessel. In at least one embodiment, oil-water separator 70 can include a cooling device (not shown) to reduce or maintain the temperature of oil-water separator 70. Oil-water separator 70 can be operated at conditions to maintain water in the liquid phase. Oil-water separator 70 can be maintained at operating conditions such that greater than 95 weight percent (wt %) of the water in depressurized effluent 160 can be maintained in the liquid phase. Operating the oil-water separator 70 such that greater than 95 wt % of the water is in the liquid phase minimizes the loss of water as steam. Water converted to steam cannot contribute to the stability of an emulsion of oil and water. Additionally, operating the oil-water separator 70 at these conditions increases the amount of hydrocarbons present in water/oil emulsion 170. Oil-water separator 70 can produce gas product stream 172, upgraded oil product 174, and water/oil emulsion 170. Upgraded oil product 174 can include upgraded hydrocarbons relative to the hydrocarbons in oil feed 100.

Water/oil emulsion 170 can include a stable emulsion of oil and water. Water loses its polarity at supercritical conditions and becomes a non-polar solvent, which enables water to dissolve hydrocarbons and access and surround the indigenous species so that oil and water become miscible. However, at supercritical conditions, water has limited interaction with polar species in the oil. After passing through pressure reducing element 60 the water in cooled effluent 150 regains its polarity and can dissolve the polar species that were exposed from within the oil molecules in SCW reactor 40. The natural surfactants include polar agents. The natural surfactants can adsorb as thin films around droplets of oil and water and then crosslink them, thus the indigenous species can act as interfacial surface tension reducing agents. The resultant oil and water solution forms the stable emulsion of oil and water.

Water/oil emulsion 170 can contain an amount of oil between 1,000 parts-per-million by weight (ppmw) and 400,000 ppmw, alternately 1,000 ppmw and 20,000 ppmw, and alternately between 3,000 and 20,000 ppmw. Complete separation of the hydrocarbons from water in depressurized effluent 160 is not obtainable and not desirable. The amount of oil in the emulsion of oil and water can be adjusted in oil-water separator. A stable emulsion of oil and water is promoted by low surface tension induced by the presence of the indigenous species in crude oil of oil feed 100. As the amount of oil in the emulsion of oil and water increases the surface tension decreases, which increases the viscosity of the emulsion of oil and water. When the amount of oil in the emulsion of oil and water is less than 1,000 ppmw the surface tension is high, about 62 milliNewtons per meter (mN/m), and the viscosity is low, less than 50 centipoise (cP). When the amount of oil in the emulsion of oil and water is greater than 400,000 ppmw the liquid yield in upgraded oil product 174 is reduced. The alkali content in water/oil emulsion 170 can be in the range between 100 ppmw and 30,000 ppmw and alternately between 1,000 ppmw and 5,000 ppmw. The total organic carbon (TOC) in the emulsion of oil and water can be in the range between 200 ppmw to 80,000 ppmw. The total dissolved solids (TDS) in the emulsion of oil and water can be in the range between 40 ppmw and 2500 ppmw and alternately in the range between 460 ppmw and 1800 ppmw. The amount of silica and calcium carbonate in the emulsion of oil and water can be in the range between 40 ppmw and 1,200 ppmw and alternately in the range between 80 ppmw and 150 ppmw.

Figure 3:
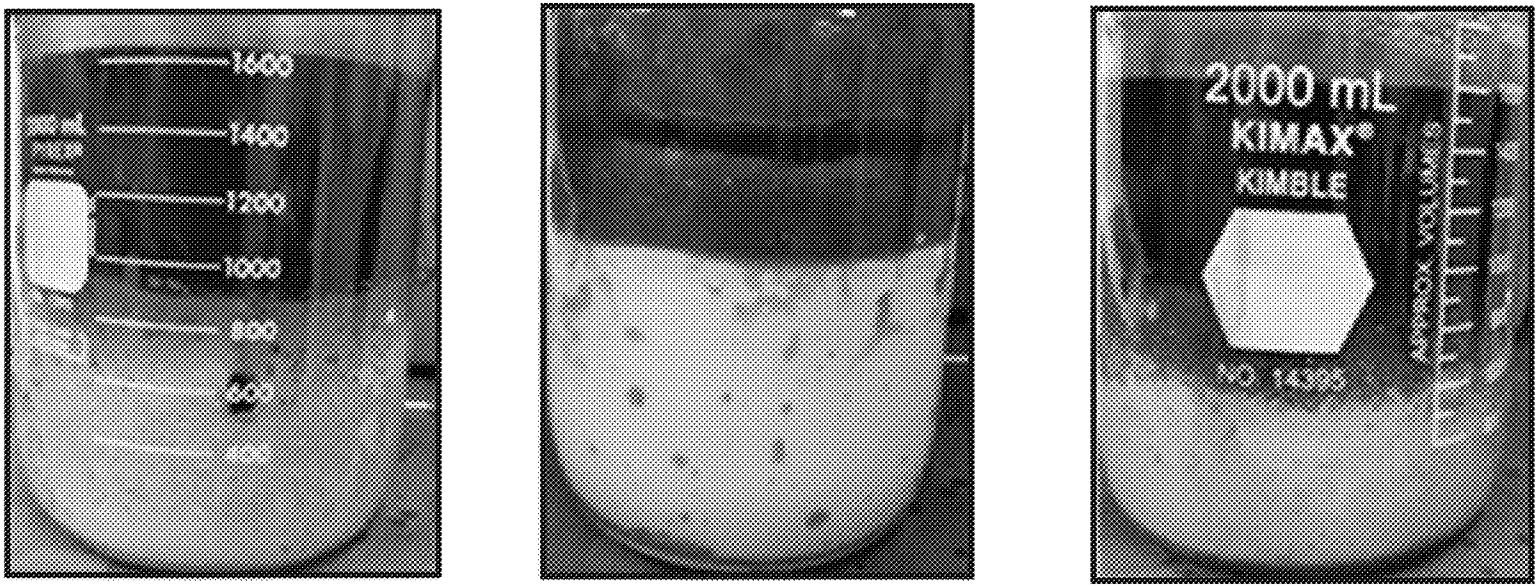
FIG. 3 provides a series of photographs depicting samples of the depressurized effluent.

In at least one embodiment, water/oil emulsion 170 is in the absence of external surfactants. In at least one embodiment, water/oil emulsion 170 includes external surfactants. The emulsion of oil and water has a milky color as seen in FIG. 3. FIG. 3 is a series of photographs depicting samples of depressurized effluent 160. The dark top layer in each container contains 95 wt % to 100 wt % oil. The bottom milky layer is an emulsion of oil and water where the water makes up 20 wt % to 50 wt %.

Water/oil emulsion 170 can be sent to a production site to be injected into the oil-containing formation as enhanced oil recovery stream 176. Enhanced oil recovery stream 176 can be maintained at pressures greater than the water saturation pressure at temperatures in the range of 90 deg C. to 120 deg C. and can act as a displacement fluid forcing hydrocarbons from the oil-containing formation such that the oil can be collected at a surface. Advantageously, the enhanced oil recovery stream 176 can have a viscosity sufficient to overcome the capillary forces in the oil-containing formation.

The alkali content present in oil feed 100 can stabilize the emulsion of oil and water in water/oil emulsion 170. When the alkali content is below the threshold to maintain the stability of the emulsion of oil and water an additional water stream can be added. In at least one embodiment, the threshold of alkali content is 10 PTB. The additional water stream can be added downstream of SCW reactor 40, and alternately downstream of oil-water separator 70. Adding the water downstream of SCW reactor 40 avoids damaging SCW reactor 40.

Referring to FIG. 2, an alternate embodiment of the process to produce a displacement fluid for use in an oil-containing formation is provided. In the alternate embodiment, a portion of water/oil emulsion 170 can be separated as separated water stream 178. Separated water stream 178 can be introduced to waste water treatment facility 75. Waste water treatment facility 75 can be any type of waste water treatment unit capable of treating a waste water stream to produce a clean water stream, where the clean water stream contains less amount of contaminants than separated water stream 178. Contaminants in separated water stream 178 that can be removed include dissolved metals, total dissolved solids (TDS), and total organic content (TOC). Water treatment facility 75 can include filtering units, ion exchange units, oxidation units, and combinations of the same. Waste water treatment facility 75 can treat separated water stream 178 to produce treated water stream 175. Treated water stream 175 can be mixed with pressurized water feed 120.

Figure 4:
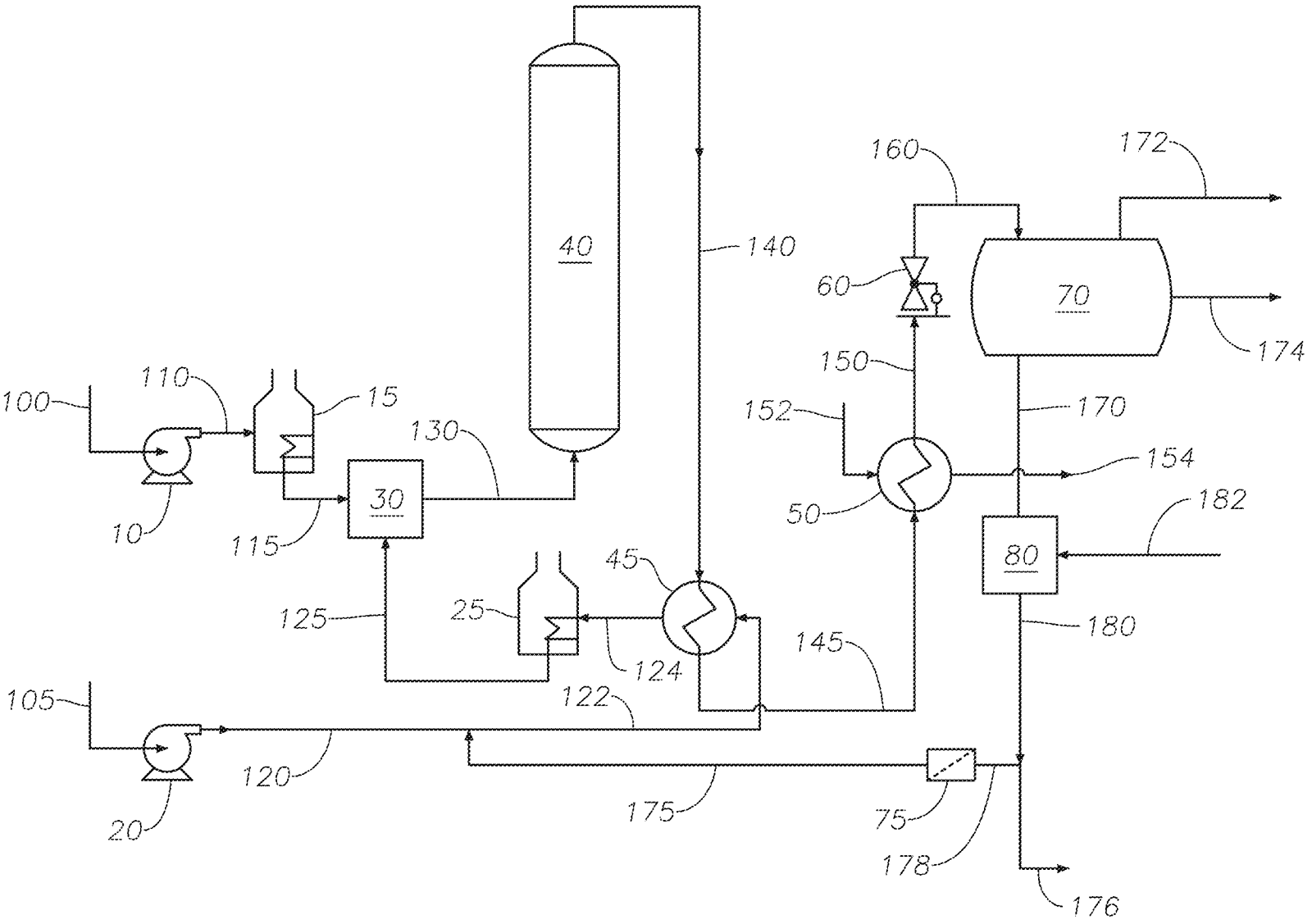
FIG. 4 provides a process diagram of an embodiment of the upgrading process.

An alternate embodiment of the process to produce a displacement fluid for use in an oil-containing formation is provided is provided with reference to FIG. 4. Water/oil emulsion 170 can be introduced to desalter mixer 80 along with desalter water 182. Desalter water 182 can be from a desalter unit. Desalter water 182 can include water and alkali content. The alkali content in desalter water 182 can be in the range between 26,000 ppmw and 367,500 ppmw (108, 900 PTB) and alternately in the range between 26,000 ppmw (7,650 PTB) and 91,550 ppmw (27,000 PTB). Desalter mixer 80 can be any type of mixing unit capable of mixing two aqueous streams to produce a stable emulsion. Desalter water 182 and water/oil emulsion 170 can be mixed in desalter mixer 80 to produce stabilized emulsion 180. Stabilized emulsion 180 can include a stable emulsion of oil and water. Stabilized emulsion 180 can be sent to a production site to be injected into the oil well formation as enhanced oil recovery stream 176.

Figure 5:
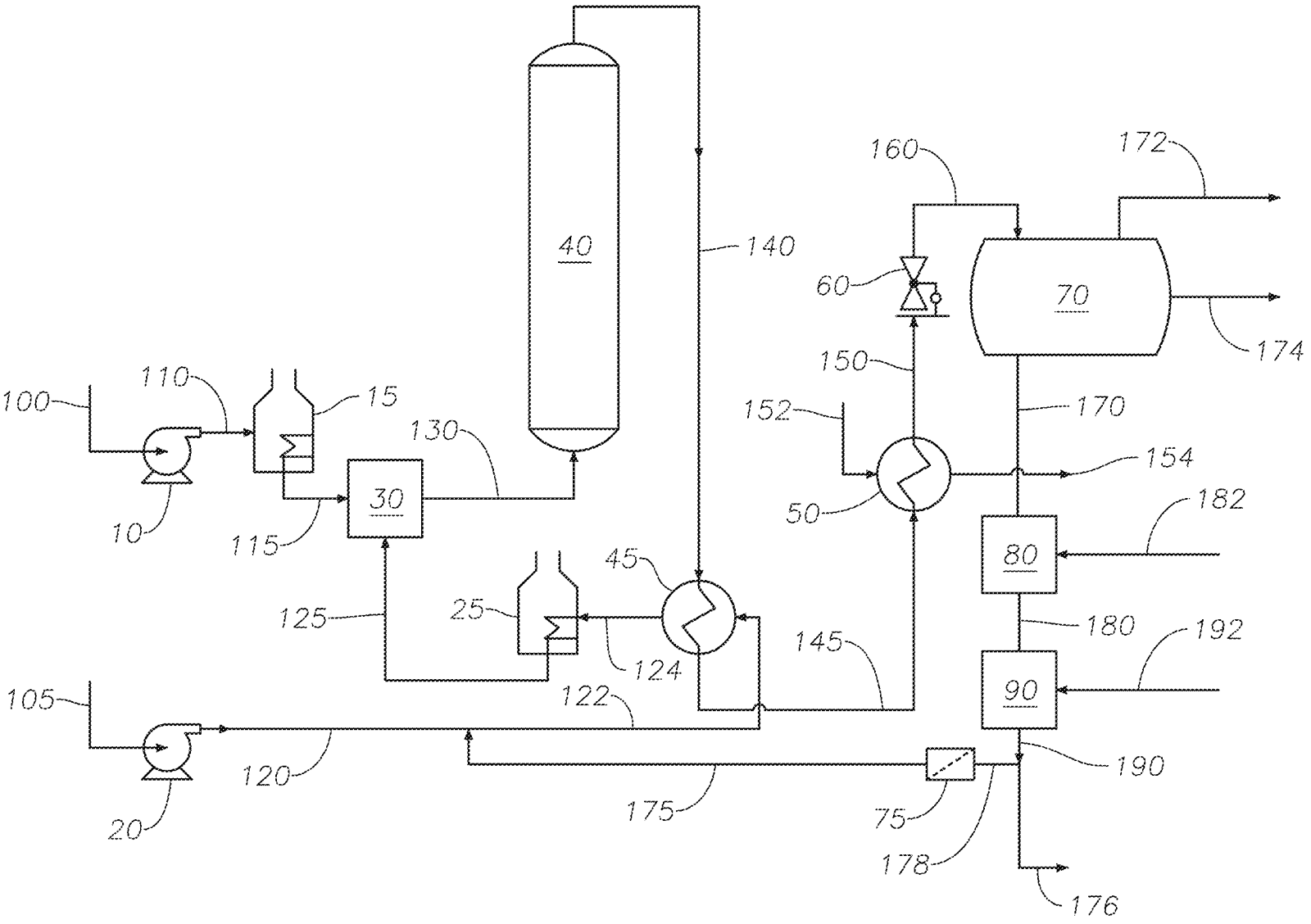
FIG. 5 provides a process diagram of an embodiment of the upgrading process.

Referring to FIG. 5, an alternate embodiment of the process to produce a displacement fluid for use in an oil-containing formation is provided. Stabilized emulsion 180 can be introduced to production mixer 90 along with produced water stream 192. Produced water stream 192 can be from a gas oil separation plant. Produced water stream 192 can include alkali content in the range between 20,000 parts-per-million weight (ppmw) and 600,000 ppmw, alternately between 26,000 parts-per-million weight (ppmw) and 367,500 ppmw and alternately in the range between 26,000 ppmw and 91,550 ppmw. The amount of silica and calcium in produced water stream 192 can be greater than the amount of silica and calcium in water/oil emulsion 170. Production mixer 90 can be any type of mixing unit capable of mixing two aqueous streams to produce a stable emulsion. Stabilized emulsion 180 and produced water stream 192 can be mixed in production mixer 90 to produce mixed recovery water 190. Mixed recovery water 190 can include a stable emulsion of oil and water. Mixed recovery water 190 can be sent to a production site to be injected into the oil well formation as enhanced oil recovery stream 176. The combination of desalter mixer 80 and production mixer 90 can improve the stability of the mixed recovery water 190.

Desalter water 182 has a composition that is closer to the composition of water/oil emulsion 170 in terms of amount of metals, total dissolved solids (TDS) and total organic content (TOC) and contains less metals, TDS and TOC compared to produced water stream 192. Placing desalter mixer 80 upstream of production mixer 90 results in a mixed recovery water 190 that is more homogenous that a mixture that would be produced if production mixer 90 is upstream of desalter mixer 80.

Enhanced oil recovery stream 176 is in the absence of steam. Steam cannot form a stable emulsion with oil.

Examples

The Example is a simulated analysis of the process for producing a displacement fluid for use in an oil-containing formation. The simulation is according to the process of FIG. 1. Oil feed 100 was introduced at a flow rate of 650 kg/h and a temperature of 60 deg C. The pressure of oil feed 100 was increased in oil pump 10 to 25 MPa and the temperature was increased oil heater 15 to 200 deg C. to produce pre-heated oil feed 115 at a temperature of 200 deg C. and 25 MPa. Water feed 105 was introduced at flow rate of 975 kg/h and a temperature of 25 deg C. The pressure was increased in water pump 20 and the temperature was increased in water cross-heater 45 and water heater 25 to produce supercritical water feed at a temperature of 450 deg C. and a pressure of 25 MPa. Mixed feed 130 had a temperature of 379 deg C. and 25 MPa and a total flow rate of 1625 kg/h. Mixed feed 130 is introduced to SCW reactor 40. Reactor effluent 140 is at a temperature of 420 deg C. and 25 MPa and a flow rate of 1625 kg/h. The temperature of reactor effluent is reduced in water cross-heater 45 and process cooler 50 and then the pressure is reduced in pressure reducing element 60 to produce depressurized effluent 160. Depressurized effluent 160 is at a temperature of 90 deg C. and atmospheric pressure. Depressurized effluent 160 is introduced to oil-water separator 70. Oil-water separator separates depressurized effluent into gas product stream 172, upgraded oil product 174, and water/oil emulsion 170. The flow rate of gas product stream 172 is 4 kg/h. The flow rate of upgraded oil product 174 is 631 kg/h. The flow rate of water/oil emulsion 170 is 990 kg/h containing 15 kg/hr of oil, resulting in an oil fraction of 1.51 wt %.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A process directed toward enhanced oil recovery in an oil-containing formation, the process comprising the steps of:

increasing a pressure of an oil feed in an oil pump to produce a pressurized oil feed, wherein an alkali content of the oil feed is less than 300 pounds per thousand barrels;

increasing a temperature of the pressurized oil feed in an oil heater to produce a pre-heated oil feed, wherein the temperature of the pre-heated oil is in the range between 50 deg C. and 250 deg C.;

increasing a pressure of a water feed in a water pump to produce a pressurized water feed;

increasing a temperature of the pressurized water feed in a water cross-heater to produce a pre-heated water feed;

increasing a temperature of the pre-heated water feed in a water heater to produce a supercritical water feed, wherein a temperature of the supercritical water feed is in the range between 374 deg C. and 600 deg C.;

mixing the pre-heated oil feed and the supercritical water feed in a mixer to produce a mixed feed, wherein a volumetric ratio of the volumetric flow rate of the supercritical water feed to the volumetric flow rate of the pre-heated oil feed is in the range between 5:1 to 1:1;

introducing the mixed feed to a supercritical water (SCW) reactor;

treating the mixed feed in the SCW reactor to produce a reactor effluent, wherein a reaction temperature in the SCW reactor is in the range between 380 deg C. and 600 deg C., wherein a reaction pressure is in the range between 22 MPa and 30 MPa, wherein a residence time in the SCW reactor is in the range between 10 seconds and 60 minutes;

reducing a temperature of the reactor effluent in the water cross-heater to produce a pre-cooled effluent;

reducing a temperature of the pre-cooled effluent in a process cooler to produce a cooled effluent, wherein a temperature of the cooled effluent is less than 120 deg C.;

reducing a pressure of the cooled effluent in a pressure reducing element to produce a depressurized effluent, wherein the depressurized effluent is at a pressure greater than the saturation pressure at the temperature of the cooled effluent;

separating the depressurized effluent in the oil-water separator to produce a gas product stream, an upgraded oil product, and a water/oil emulsion, wherein the upgraded oil product contains upgraded hydrocarbons relative to the hydrocarbons in the oil feed;

removing the water/oil emulsion from the oil-water separator, wherein the water/oil emulsion comprises a stable emulsion of oil and water, wherein a temperature of the water/oil emulsion is less than 120 deg C., wherein a pressure of the water/oil emulsion is greater than the saturation pressure at the temperature of the water/oil emulsion, wherein the water/oil emulsion comprises an alkali content; and introducing the water/oil emulsion into the oil-containing formation as an enhanced oil recovery stream, wherein the enhanced oil recovery stream is used in enhanced oil recovery.

2. The process of claim 1, further comprising the steps of:

introducing the water/oil emulsion to a desalter mixer;

introducing a desalter water to the desalter mixer, wherein the desalter water comprises an alkali content, wherein the alkali content is the range between 26,000 ppmw and 367,500 ppmw;

mixing the water/oil emulsion and the desalter water in the desalter mixer to produce a stabilized emulsion; and introducing the stabilized emulsion into the oil-containing formation as an enhanced oil recovery stream, wherein the enhanced oil recovery stream is used in enhanced oil recovery.

3. The process of claim 2, further comprising the steps of:

introducing the stabilized emulsion to a production mixer;

introducing a produced water stream to the production mixer, wherein an alkali content of the produced water stream is in the range between 20,000 ppmw and 600,000 ppmw;

mixing the stabilized emulsion and the produced water stream in the production mixer to produce a mixed recovery water; and introducing the mixed recovery water into the oil-containing formation as an enhanced oil recovery stream, wherein the enhanced oil recovery stream is used in enhanced oil recovery.

4. The process of claim 1, further comprising the steps of:

separating a separated water stream from the water/oil emulsion;

introducing the separated water stream to a waste water treatment facility;

treating the separated water stream in the waste water treatment facility to produce a treated water stream, wherein the treated water stream comprises fewer contaminants than the separated water stream; and mixing the treated water stream with a pressurized water feed to a produce mixed water feed.

5. The process of claim 1, wherein the alkali content of the water/oil emulsion is in the range between 20,000 ppmw and 600,000 ppmw.

6. The process of claim 1, wherein the oil feed comprises oil recovered in the enhanced oil recovery.

7. The process of claim 1, wherein the amount of oil in the water/oil emulsion is in the range between 30,000 ppmw and 400,000 ppmw.

8. The process of claim 1, wherein the operating conditions in the oil-separator are maintained such that greater than 95 wt % of the water in the oil-water separator is in the liquid phase.

9. A system for producing an enhanced oil recovery stream for enhanced oil recovery, the system comprising:

a supercritical water (SCW) reactor, the SCW reactor configured to treat a mixed feed to produce a reactor effluent, wherein the mixed feed comprises a pre-heated oil feed and a supercritical water feed, wherein a reaction temperature in the SCW reactor is in the range between 380 deg C. and 600 deg C., wherein a reaction pressure is in the range between 22 MPa and 30 MPa, wherein a residence time in the SCW reactor is in the range between 10 seconds and 60 minutes;

a water cross-heater fluidly connected to the SCW reactor, the SCW reactor configured to reduce a temperature of the reactor effluent to produce a pre-cooled effluent;

a process cooler fluidly connected to the water cross-heater, the process cooler configured to reduce a temperature of the pre-cooled effluent in to produce a cooled effluent, wherein a temperature of the cooled effluent is less than 120 deg C.;

a pressure reducing element fluidly connected to the process cooler, the pressure reducing element configured to reduce a pressure of the cooled effluent to produce a depressurized effluent, wherein the depressurized effluent is at a pressure greater than the saturation pressure at the temperature of the cooled effluent; and an oil-water separator fluidly connected to the pressure reducing element, the oil-water separator configured to separate the depressurized effluent to produce a gas product stream, an upgraded oil product, and a water oil emulsion, wherein the upgraded oil product contains upgraded hydrocarbons relative to the hydrocarbons in the oil feed, where the water/oil emulsion comprises a stable emulsion, wherein a pressure of the water/oil emulsion is greater than the saturation pressure at the temperature of the water/oil emulsion, wherein the water/oil emulsion comprises an alkali content.

10. The system of claim 9, further comprising an oil-containing formation fluidly connected to the oil-water separator, wherein the water/oil emulsion is operable to be injected into the oil-containing formation as the enhanced oil recovery stream.

11. The system of claim 9, further comprising a desalter mixer fluidly connected to the oil-water separator, the desalter mixer configured to mix the oil/water emulsion and a desalter water to produce a stabilized emulsion, wherein the desalter water comprises an alkali content, wherein the alkali content is the range between 26,000 ppmw and 367,500 ppmw.

12. The system of claim 11, further comprising a production mixer fluidly connected to the desalter mixer, the production mixer configured to mix the stabilized emulsion and a produced water stream to produce a mixed recovery water.

13. The system of claim 9, further comprising a waste water treatment facility, the waste water treatment facility configured to treat a separated water stream to produce a treated water stream, wherein the separated water stream is separated from the water/oil emulsion.

14. The system of claim 9, further comprising an oil pump, the oil pump configured to increase a pressure of an oil feed to produce a pressurized oil feed, wherein an alkali content of the oil feed is less than 300 pounds per thousand barrels;

an oil heater fluidly connected to the oil pump, the oil heater configured to increase a temperature of the pressurized oil feed to produce a pre-heated oil feed, wherein the temperature of the pre-heated oil is in the range between 50 deg C. and 250 deg C.;

a water pump, the water pump configured to increase a pressure of a water feed to produce a pressurized water feed;

a water cross-heater fluidly connected to the water pump, the water cross-heater configured to increase a temperature of the pressurized water feed to produce a pre-heated water feed;

a water heater fluidly connected to the water cross-heater, the water heater configured to increase a temperature of the pre-heated water feed to produce a supercritical water feed, wherein a temperature of the supercritical water feed is in the range between 374 deg C. and 600 deg C.; and a mixer fluidly connected to the oil heater and the water heater, the mixer configured to mix the pre-heated oil and the supercritical water feed to produce the mixed feed.

15. The system of claim 9, wherein a volumetric ratio of the volumetric flow rate of the supercritical water feed to the volumetric flow rate of the pre-heated oil feed is in the range between 5:1 to 1:1.

16. The system of claim 9, wherein the alkali content of the water/oil emulsion is in the range between 100 ppmw and 30,000 ppmw.

17. The system of claim 14, wherein the oil feed comprises oil recovered in the enhanced oil recovery.

18. The system of claim 9, wherein the amount of oil in the water/oil emulsion is in the range between 30,000 ppmw and 400,000 ppmw.

19. The system of claim 9, wherein the operating conditions in the oil-separator are maintained such that greater than 95 wt % of the water in the oil-water separator is in the liquid phase.

* * * * *